US010427850B2

(12) United States Patent
Akerman

(10) Patent No.: US 10,427,850 B2
(45) Date of Patent: Oct. 1, 2019

(54) QUICK-ADJUST TENSIONER

(71) Applicant: Akerworks, Inc., Knoxville, TN (US)

(72) Inventor: Adan Akerman, Knoxville, TN (US)

(73) Assignee: Akerworks, Inc., Knoxville, TN (US)

( * ) Notice: Subject to any disclaimer, the term of this patent is extended or adjusted under 35 U.S.C. 154(b) by 71 days.

(21) Appl. No.: 15/689,031

(22) Filed: Aug. 29, 2017

(65) Prior Publication Data

US 2018/0111732 A1 Apr. 26, 2018

Related U.S. Application Data

(60) Provisional application No. 62/412,320, filed on Oct. 25, 2016.

(51) Int. Cl.

| | |
|---|---|
| ***B65D 63/14*** | (2006.01) |
| ***D05B 43/00*** | (2006.01) |
| ***B65H 49/28*** | (2006.01) |
| ***B65H 59/04*** | (2006.01) |
| ***B65H 75/44*** | (2006.01) |
| *B65H 54/54* | (2006.01) |

(52) U.S. Cl.

CPC ..... *B65D 63/14* (2013.01); *B65H 49/28* (2013.01); *B65H 59/04* (2013.01); *B65H 75/4444* (2013.01); *D05B 43/00* (2013.01); *B65H 54/54* (2013.01); *B65H 2701/31* (2013.01)

(58) Field of Classification Search

CPC ..... B65D 63/14; B65H 49/28; B65H 59/04; B65H 75/444; B65H 54/54; D05B 43/00; Y10T 24/1498; Y10T 24/14; Y10T 24/141

See application file for complete search history.

(56) References Cited

U.S. PATENT DOCUMENTS

| | | | | |
|---|---|---|---|---|
| 1,290,433 A * | 1/1919 | Walker | A47F 5/0006 | 248/690 |
| 1,364,259 A | 1/1921 | Eaton | | |
| 2,581,849 A * | 1/1952 | Fisch | B65D 35/42 | 220/288 |
| 2,757,882 A | 8/1956 | Maitland | | |
| 3,098,374 A | 7/1963 | Langston | | |
| 3,603,306 A * | 9/1971 | Bonin, Jr. | B63C 11/205 | 128/201.11 |
| 4,724,971 A * | 2/1988 | Henline | B65D 23/106 | 16/111.1 |

(Continued)

OTHER PUBLICATIONS

American Standard Spring Clip, for Pivot Rod http://www.build.com/american-standard-072531-0070a/s26612?uid.

(Continued)

*Primary Examiner* — Robert Sandy
*Assistant Examiner* — Michael S Lee
(74) *Attorney, Agent, or Firm* — Kenneth C. Spafford

(57) ABSTRACT

Quick-adjust tensioner that exerts a braking torque on a spool. The tensioner includes a stop configured to fit onto a rod supporting the spool. The location of the stop on the rod is adjustable by the user. The stop is connected to a foot by a biasing member. The biasing member presses the foot against the spool to create a braking torque on the spool. The force of the biasing member on the foot is predetermined by adjusting the distance between the stop and the foot, thereby adjusting the foot's braking torque on the spool.

17 Claims, 8 Drawing Sheets

(56) References Cited

U.S. PATENT DOCUMENTS 5,522,122 A * 6/1996 Turchick ..... B62J 6/00 224/420
5,575,555 A * 11/1996 Chang ..... F21L 15/08 362/109
5,692,268 A * 12/1997 Case ..... B62J 6/00 224/420
5,749,490 A * 5/1998 Keicher ..... B65D 23/003 215/396
5,836,053 A * 11/1998 Davignon ..... F16L 3/233 24/16 PB
6,192,554 B1 * 2/2001 Dumcum ..... B65D 63/1018 24/16 PB
6,311,935 B1 * 11/2001 Mullen, Jr. ..... H02G 3/32 24/16 PB
D467,492 S * 12/2002 Wieder ..... D8/356
6,523,229 B2 * 2/2003 Severson ..... B65D 63/1018 24/16 PB
D489,263 S * 5/2004 Sinanian ..... D9/455
D510,884 S * 10/2005 Sayegh ..... D10/106.91
2003/0159254 A1 * 8/2003 Wendle ..... B65D 63/1027 24/16 PB
2003/0182766 A1 * 10/2003 Avinger ..... B65D 63/1027 24/16 PB
2005/0251967 A1 * 11/2005 McNeill ..... B65D 63/1027 24/16 PB
2011/0107558 A1 * 5/2011 Hua ..... B60T 17/046 24/16 PB
2011/0225777 A1 9/2011 Arjomand
2015/0165986 A1 * 6/2015 Morris ..... B60R 16/0215 280/728.2
2015/0223573 A1 * 8/2015 Vecchione ..... A44B 99/00 24/16 PB
2015/0225150 A1 * 8/2015 Farrell ..... B65D 63/14 24/16 PB

OTHER PUBLICATIONS

Installation and Care Guide, Two-Handle Lavatory Faucet, Glacier Bay Model#67392-6104, pp. 6 and 7.
Tension Check Springs for Pfaff Sewing Machines http://www.cutexsewingsupplies.com/catalogsearch/result/?cat=&q=Tension+Check+Spring+Pfaff+1245.
Pfaff, List of Spare Parts, No. 296-12-14731 for part 246, 1246, pp. 14, 53, and 82.
V shape spring clip http://www.vantech.me/products/V-shape-spring-clip_791.html.

* cited by examiner

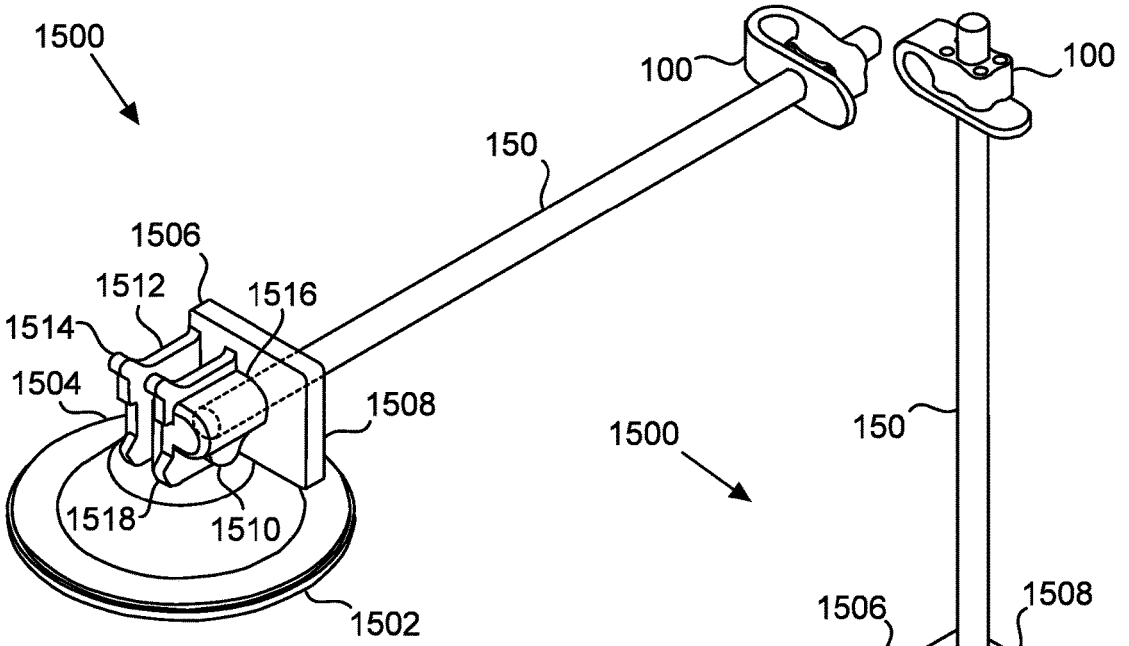
Fig. 15
Fig. 16
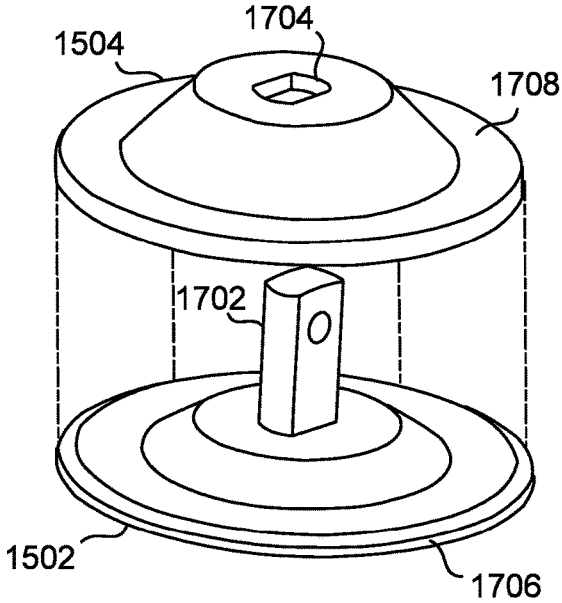
Fig. 17
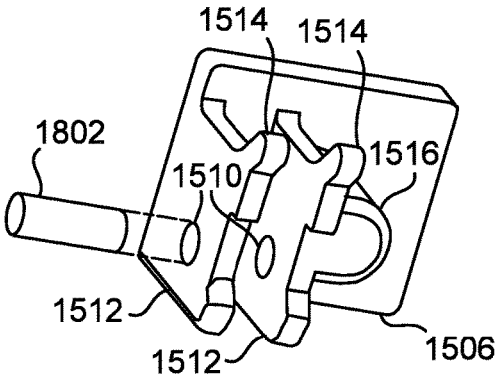
Fig. 18

QUICK-ADJUST TENSIONER

CROSS-REFERENCE TO RELATED APPLICATIONS

This application claims the benefit of provisional Application No. 62/412,320, filed Oct. 25, 2016.

STATEMENT REGARDING FEDERALLY SPONSORED RESEARCH OR DEVELOPMENT

Not Applicable.

BACKGROUND

1. Field of Invention

This invention pertains to tensioners. More particularly, this invention pertains to quick-adjust tensioners for spooling materials.

2. Description of the Related Art

Tensioners are commonly used to regulate the speed at which spooled materials are dispensed, and to tauten the material leaving the spool. A tensioner creates a braking torque on the spool, thereby counteracting the pull of the thread or other spooled material on the spool. Many tensioners create the braking torque with a fixed object pressed against a spool end. The braking torque creates kinetic friction between the immovable object and the spool. The braking torque also creates static friction between the immovable object and the spool, thereby allowing the spool to be held in place when needed.

An example of a traditional tensioner is displayed in U.S. Pat. No. 1,364,259 by Eaton. The Eaton tensioner includes a winged bolt securing a stop collar to a rod upon which a bobbin is also fitted. The stop collar compresses a spring against a disc which in turn presses against the bobbin. The disc pressing against the bobbin creates a braking torque on the spool and tensions the silk or other thread being pulled from the bobbin. The Easton tensioner, like most standard tensioners, is made of multiple assembled parts and different materials.

However, standard tensioners do not allow the user to quickly remove the tensioner or to quickly adjust the amount of braking torque that the tensioner exerts on the spool. Moreover, multiple torque adjustments of an standard tensioner will eventually wear out both the tensioner and the supporting rod upon which is it situated. In addition, standard tensioners are usually comprised of multiple pieces, each of which is made of a different material and requires separate manufacturing.

An example of a strip with apertures on each end is displayed in US Patent Application Pub. No. 2011/0225777, by Arjomand, titled "Adjustable-length tie wrap." Arjomand discloses in FIG. 12 a tie-wrap with two locking heads. The heads each include a pawl. The openings in the heads are rectangular and identical in size and shape. Arjomand does not disclose that the straps connecting the heads are resilient.

BRIEF SUMMARY

According to one embodiment of the present invention, a tensioner for a spool is provided. The tensioner includes a stop configured to attach to a rod holding a spool. Static friction holds the stop in one location on the rod. The tensioner also includes a foot configured to press with a second force against the spool. The foot pressing against the spool creates a resistance against the spool turning, thus creating a braking torque. The foot also acts in conjunction with the stop to keep the spool from changing position on the rod.

The tensioner includes a biasing member between the stop and the foot. The biasing member pushes with the second force in opposite directions against both the stop and the foot. The maximum possible force of the static friction holding the stop in place is greater than the second force of the biasing member pressing against the stop. Thus, the stop stays in a fixed position on the rod when the biasing member is pressing the foot against the spool.

The distance between the stop and the foot is inversely related to the second force of the foot against the spool. The second force of the foot against the spool is directly related to the braking torque caused by the foot resisting the spool turning. Thus, the user moves the stop closer to the foot in order to increase the force of the foot on the spool and increase the braking torque. To reduce the braking torque, the user moves the stop farther away from the foot. Thus, the user is able to fine-tune the braking torque of the tensioner on the spool, and increase or decrease the tension on the line.

In some embodiments, the tensioner is a strip having two ends. The strip is made of a flexible material such as rubber or a springy plastic with a long fatigue life. The stop is proximate a first end of the strip. In some embodiments, the first end including the stop is thicker than the remainder of the strip. In other embodiments, the strip has a consistent thickness throughout. In other embodiments, each end is thicker than the middle of the strip. In other embodiments, the biasing member is thicker than the ends of the strip.

In some embodiments, the stop includes a first aperture. The aperture has at least one diameter configured to be smaller than the width of the rod, such that the stop grips with the first force to a location on the rod when the rod is inserted through the first aperture. In other embodiments, the first aperture has no diameters configured to be smaller that the width of the rod, but the stop still binds against the rod due to friction.

In some embodiments, the stop includes auxillary holes. The auxiliary holes are parallel to the first aperture. The auxiliary holes contract in response to the first aperture being expanded. Thus, the effective elasticity of the first aperture is increased by the ability of the material surrounding the first aperture to expand into the auxiliary holes.

The foot is a portion of the strip proximate to a second end of the strip. The biasing member is a portion of the strip between the foot and the stop. In some embodiments, the biasing member has a characteristic of pushing the tensioner to a straight position. Thus, when the biasing member is bent it presses against the foot and stop with the second force.

In some embodiments, the tensioner includes a guide. The guide includes a second aperture between the biasing member and the second end of the strip. Any diameter of the second aperture is greater than the thickness of the rod.

The tensioner is placed upon the rod by placing the guide's second aperture on the rod and then the stop's first aperture on the rod. The stop is slid down the rod until the foot contacts the top surface of the spool and the biasing member bends. The stop is then adjusted closer or further from the foot to bend the biasing member the desired amount such that the proper braking torque of the foot on the spool is achieved. In some embodiments, the biasing member is capable of bending sufficiently without damage even when the stop and foot are pressed against each other.

In one embodiment, the bottom of the foot includes extensions. The extensions are configured to contact the spool at an angle such that the extensions brush against the spool if the spool turns in one direction but fold and bind if the spool turns in the other direction. Thus, the extensions function to allow the spool to turn in only one direction.

In one embodiment, the tensioner is part of a line dispensing system capable of dispensing one or multiple lines. In another embodiment, the tensioner is part of a fishing reel. In another embodiment, the tensioner is part of a twine dispenser. In another embodiment, the tensioner is part of a portable ribbon dispenser. In another embodiment, multiple tensioners are part of a system of multiple rods and spools such that the braking effect of the tensioners on the material being unspooled is cumulative.

In one embodiment, the tensioner is part of a clutch system for driving screws into soft materials. The clutch system includes a sleeve that connects a shaft to a bit. The shaft rotates through motor or hand power. The shaft rotates independently of the sleeve, while the sleeve rotates in a fixed position relative to the bit. The tensioner is placed on the shaft with the foot pressed against the sleeve. The stop grips the shaft and rotates in a fixed position relative to the shaft. The foot pressing on the sleeve creates a static friction torque sticking the foot and sleeve together such that the shaft, stop, foot, sleeve and bit rotate in a fixed position relative to one another.

In one method for a clutch system, the clutch system is used on a screw being driven into a soft material, such as soft plastic, wax, or wood. The bit is inserted into the screw and the shaft turns the bit for as long as the braking torque of the screw is less than the static friction torque holding the foot and sleeve. The static friction torque between the foot and sleeve is overcome when the torque required to turn the screw (i.e., the braking torque of the screw) is greater than the static friction torque. The foot then slips from the sleeve, and the tensioner and shaft continue to spin while the sleeve and bit cease spinning, Thus, when the screw ceases to be screwed into the material is dependent upon the force of the foot against the sleeve, which in turn is dependent upon the distance between the stop and foot. Thus, the maximum torque of the bit is predetermined by the distance between the stop and foot.

In one method for a clutch system, the bit is a drill bit. The drill bit drills into a material and the shaft turns the drill bit for as long as the resistance of the material against the drill bit is less than the static friction torque holding the foot and sleeve. The static friction torque between the foot and sleeve is overcome when the torque required to turn the drill bit (i.e., the braking torque of the bit against the material) is greater than the static friction torque. The foot then slips from the sleeve, and the tensioner and shaft continue to spin while the drill bit ceases spinning, Thus, when the drill ceases to bore a hole into the material is dependent upon the force of the foot against the sleeve, which in turn is dependent upon the distance between the stop and foot. Thus, the maximum torque of the drill bit is predetermined by the distance between the stop and foot. In one example, the drill bit drills through a top layer of material, and then stops spinning once the drill bit begins to contact a second layer of material that exerts a higher friction against the drill bit.

In one embodiment, the tensioner is a removable stopper for keeping a bobbin or spool on a rod.

In one embodiment, a first and second tensioner are supports for a horizontal spindle. The first and second apertures of the first tensioner are placed on a first vertical rod, and the first and second apertures of the second tensioner are placed on a second vertical rod. A first end of the horizontal spindle is supported between the biasing member of the first tensioner and the first vertical rod. A second end of the horizontal spindle is supported between the biasing member of the second tensioner and the second vertical rod. The tensioners are then rotated a desired amount on the rod to press the respective spindle ends between their corresponding biasing member and rod, thereby applying an adjustable braking torque on the spindle.

In one embodiment, the tensioner is stored in a recess. The recess is configured to receive the tensioner such that the biasing member is bent, and the foot and stop bias against the sides of the recess and hold the tensioner in place. Thus, the tensioner remains stored in the recess even when the recess is moved, tilted, or turned over. The first and second apertures are non-aligned in the recess in order to mitigate the long-term effect of storing the biasing member in a bent position.

BRIEF DESCRIPTION OF THE SEVERAL VIEWS OF THE DRAWINGS

The above-mentioned features will become more clearly understood from the following detailed description read together with the drawings in which:

FIG. 15 is a top isometric view of another portable spool dispenser, in a folded position.

FIG. 16 is a top isometric view of the portable spool dispenser of FIG. 15, in an upright position.

FIG. 17 is an exploded view of the suction cup and suction cap portions of the portable spool dispenser of FIG. 15.

FIG. 18 is an exploded view of the cam and pivot rod portions of the portable spool dispenser of FIG. 15.

DETAILED DESCRIPTION

Apparatus for tensioning a spool is disclosed. The tensioner is generally indicated as 100, with particular embodiments and variations shown in the figures and described below having a prime designation, for example, 100'.

Figure 1:
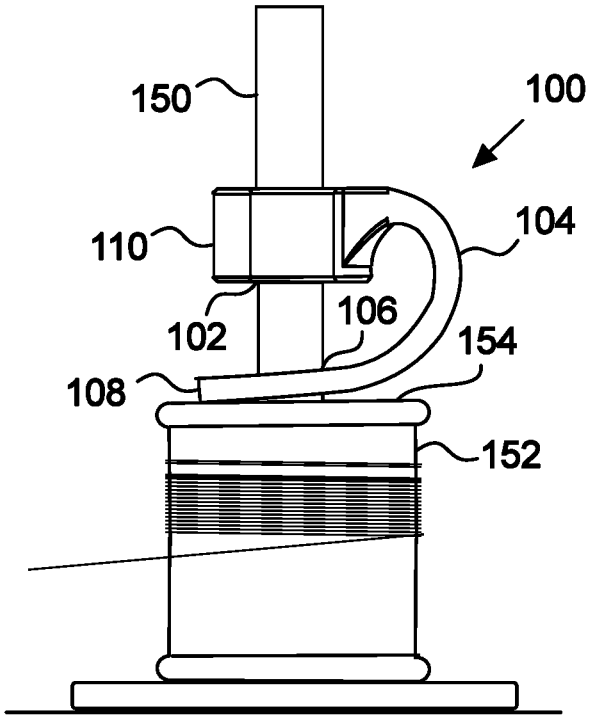
FIG. 1 is a side view of one embodiment of the tensioner on a rod, tensioning a spool.
Figure 2:
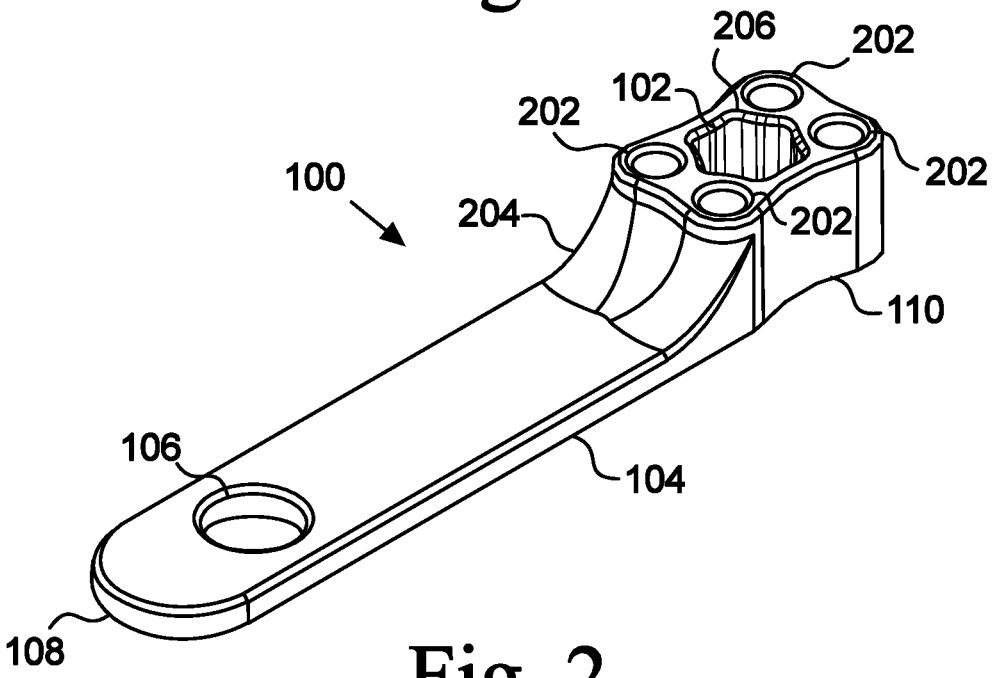
FIG. 2 is a top isometric view of one embodiment of a tensioner.
Figure 3:
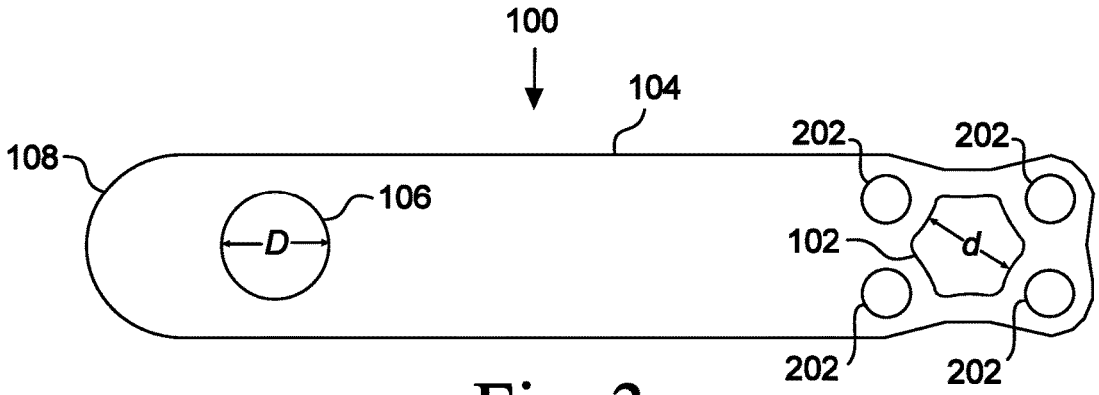
FIG. 3 is a bottom plan view of one embodiment of a tensioner.
Figure 4:
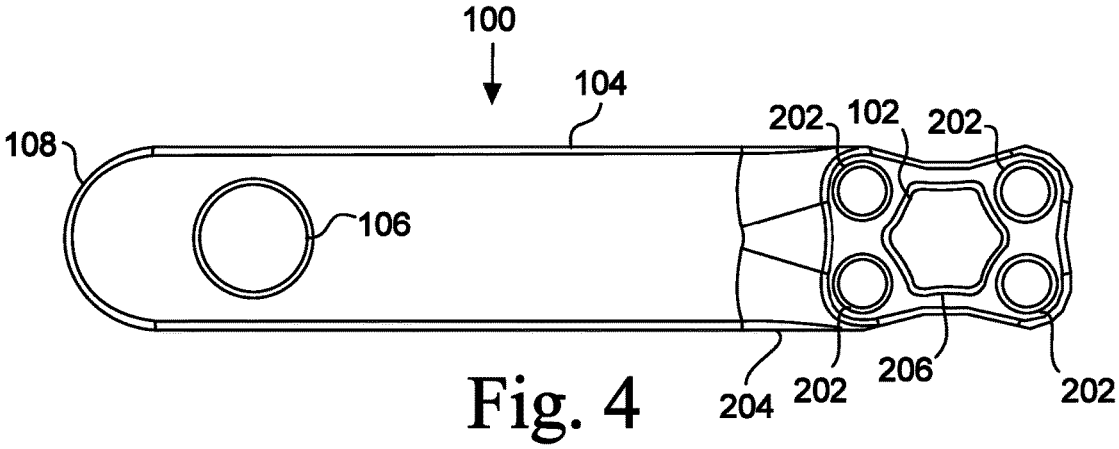
FIG. 4 is a top plan view of one embodiment of a tensioner.
Figure 5:
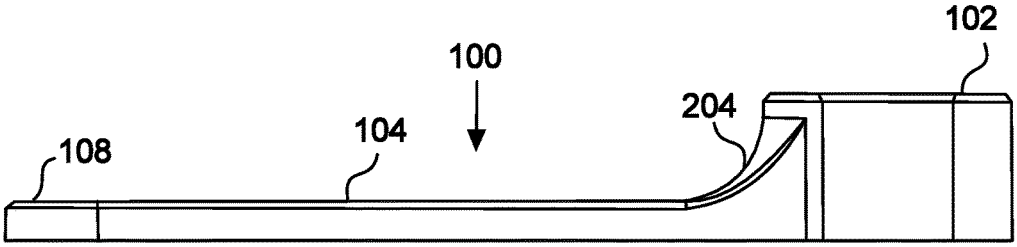
FIG. 5 is a side plan view of one embodiment of a tensioner.

As used herein, location and direction terms such as "top," "bottom," "side," "front," "horizontal," and "vertical" are relative and not fixed, and are for ease of reference and not intended to be absolute. For example, at least a portion of the "top" of a tensioner will face downward when the tensioner is in use as shown in FIG. 1. As another example, a tensioner may be used on either a vertical or a horizontal rod that supports a spool, even though in the majority of examples described below the illustrated rod is vertical.

FIG. 1 illustrates a tensioner 100 inserted onto a rod 150 for a spool 152. The stop 110 grips the rod 150 at a fixed location on the rod 150. The biasing member 104 exerts equal forces upward against the stop 110 and downward against the foot 108. The force of the biasing member 104 is not great enough to move the stop 110. However, the biasing member 104 does press the foot 108 against the top surface 154 of the spool 152, creating a consistent braking torque on the spool 152.

The biasing member 104 is composed of an elastic material, such as rubber or soft plastic, that has a long fatigue life. In some embodiments, the biasing member 104 includes reinforcements such as an internal metal spring clip. In some embodiments, the biasing member 104 is metal, shaped to function as a spring.

In the displayed embodiment 100, the biasing member 104 is resilient and has a bias to return to a straight position. Thus, reducing the distance between the stop 110 and the foot 108 will increase the spring force of the biasing member 104, thereby creating a greater braking torque of the foot 108 on the spool 152. Likewise, increasing the distance between the stop 110 and the foot 108 will reduce the force of the biasing member 104 pressing the foot 108 downward, and the braking torque on the spool 152 will be reduced. Thus, the user predetermines, in one way, the braking torque on the spool 152 by fixing the distance between the stop 110 and the foot 108.

FIGS. 2, 3, 4, and 5 illustrate an embodiment of the tensioner 100 in a rest position. In the displayed embodiment 100, the biasing member 104 is straight and flat when in a rest position. In other embodiments, the biasing member 104 is at rest in a curved position. In other embodiments, the biasing member 104 is in an angled bent configuration.

In one embodiment, the entire tensioner 100 is a single piece and made of the same material throughout, thereby making the tensioner 100 easier and cheaper to manufacture and maintain. The biasing member 104 is made of a flexible and resilient material. In one embodiment, the biasing member 104 is rubber. In another embodiment, the biasing member is 104 plastic. In another embodiment, the biasing member 104 is a thermoplastic elastomer.

In one embodiment, the tensioner 100 is made of a thermoplastic polyurethane. The material has a tensile strength of 31.0 MPa (4,500 psi). The material has a Shore Hardness rating of 83 on the A scale for the ATSM D2240 Test Method. The material has a flexural modulus of 26.9 MPa (3,900 psi) at room temperature (23 degrees Celsius) under the ASTM D790 Test Method. In another embodiment, the modulus of the material is greater, thereby increasing the force of the biasing member 104 pressing the foot 108 downward when the biasing member 104 is bent. Thus, the braking force of the tensioner 100 is controlled by varying the material the tensioner 100 is made of, while maintaining the same tensioner 100 dimensions.

In one embodiment, the tensioner 100 is made of a thermoplastic polyurethane sold commercially as TEXIN® 983 by Bayer MaterialScience.

In the displayed embodiment shown in FIGS. 1-5, the biasing member 104 includes a transition portion 204 connected to the stop 110. The transition portion 204 is radiused in order to reduce the fatigue where the biasing member 104 is connected to the stop 110. In the displayed embodiment, the bottom of the transition portion 204 is parallel with the bottom of the other parts of the tensioner 100. The top of the transition portion 204 slopes downward from the top of the stop 110, such that the flat portion of the biasing member 104 is coplanar with the bottom of the stop 110, but not coplanar with the top of the stop 110, when the tensioner 100 is in a rest position.

In one method of use, the tensioner 100 is placed onto a rod 150 with the top of the stop 110 facing downward, as shown in FIG. 1. In another method of use, the tensioner 100 is placed onto the rod 150 with the top of the stop 110 facing upward. The spring force of the biasing member 104 when the stop 110 and foot 108 are spaced at a given distance from one another depends upon whether top of the stop 110 is facing toward or away from the foot 108. Thus, the possible range of the braking torque of the foot 108 on the spool 152 is predetermined by whether the stop 110 is inserted onto the rod 150 right-side up, as shown in FIG. 1, or upside-down.

In the displayed embodiment, the stop 110 is made of an elastic material, such as rubber or soft plastic. The stop 110 is capable of distorting and returning to its original shape. The stop 110 and rod 150 have a coefficient of static friction that allows the stop 110 to stay secured at one location on the rod even when the biasing member 104 is pressing against the stop 110. In the displayed embodiment, the stop 110 is thicker than the remainder of the tensioner 100. In other embodiments, the stop 110 is equal in thickness to the remainder of the tensioner 100. In other embodiments, the stop 110 is less thick than the remainder of the tensioner 100.

In the displayed embodiment, the stop 110 includes a first aperture 102 that extends through the stop 110, such that the stop 110 may be inserted onto the rod 150. At least a portion of the material defining the first aperture 102 is flexible and resilient. In other embodiments, the stop 110 includes a recess (not shown) rather than an aperture 102, where the recess (not shown) does not extend completely through the stop 110. Thus, the maximum amount the stop 110 may be inserted onto the rod 150 is predetermined by the depth of the recess (not shown). In other embodiments, the stop 110 is a spring clamp for grasping the rod 150.

In the displayed embodiment, the top of the first aperture 102 includes a beveled portion 206. The outer circumference of the beveled portion 206 is greater than the diameter of the rod 150, allowing for easier transition in superpositioning the aperture 102 to place onto the rod 150. In another embodiment, the aperture 102 does not include a beveled portion. In some embodiments, the tensioner 100 is manufactured, for purposes of cost-effectiveness, without any beveling on the top surfaces of the first aperture 102, the auxiliary holes 202, the stop 110, the transition portion 204, the biasing member 104, or the foot 108.

The first aperture 102 has at least one diameter d that is less that the diameter of the rod 150. Thus, at least two surfaces of the first aperture 102 bias against the rod 150 and hold the stop 110 in place with a static friction. In the displayed embodiment, the first aperture 102 does not have a uniform diameter, in order to allow the stop 110 to distort more easily in response to being placed on the rod 150. In other embodiments, the first aperture 102 is circular.

The static friction holding the stop 110 in place is not so great as to prevent the user from sliding the stop 110 up and down the rod 150 as needed. For example, a particular stop 110 may be configured to hold onto a rod 150 of a particular diameter with a static friction force of up to 100 Newtons. Thus, a user with a hand strength of greater than 100 Newtons will be able to move the stop 110 as needed, or remove the tensioner 100 from the rod entirely. In some embodiments, the maximum static friction force holding the stop 110 in place will be greater than the kinetic friction force of the stop 110 against the rod 150. Thus, in one method of use, a user is able to overcome the initial static friction force by first twisting the tensioner 100, using the bent biasing member 104 that sticks out as a lever.

The maximum static friction first force is configured to be less than a user's grip strength, such that the user is able to move the stop 110 to a different location on the rod 150. In one example, the first force is configured to be less than the grip strength of the dominant hand of an average 6-year-old girl, which is approximately 83 Newtons. Thus, in this example, a 6-year-old girl with average grip strength is able to move the stop to different locations on the rod 150, or remove the tensioner 100 from the rod 150 entirely. The user's ability to move the stop 110 allows the user to secure the spool 152 to one location on the rod 150, as well as adjust the braking torque of the foot 108 on the spool 152.

The maximum static friction force of the stop 110 on the rod 150 is configured be greater that the force of the biasing member 104 against the foot 108 and stop 110. Thus, the force of the biasing member 104 does not move the stop 110. For example, where the force of the biasing member against either the stop 110 or foot 108 is less than 83 Newtons regardless of the distance between the foot 108 and stop 110, the maximum static friction first force is 83 Newtons.

The stop 110 includes auxiliary holes 202. The material between the aperture 102 and auxiliary holes 202 is flexible and resilient. The auxiliary holes 202 allow stop 110 material surrounding the first aperture 102 to expand into the auxiliary holes 202, thereby allowing the first aperture 102 to have greater elastic range. In other embodiments, the stop 110 includes a different number of auxiliary holes 202, or no auxiliary holes at all. In one method of use, an auxiliary hole 202 is effectively used as the primary stop holding mechanism, i.e., the stop 110 is placed on a rod 150 through an auxiliary hole 202, where the rod 150 has a diameter slightly larger than the diameter of the auxiliary hole 202. In another method of use, multiple auxiliary holes 202 are inserted onto multiple rods 150. In another method of use, the stop 110 includes multiple apertures 102 to place on multiple rods 150 simultaneously. In another method of use, the stop 110 is placed on multiple rods 150 through a combination of the tensioner's 110 first apertures 102 and auxiliary holes 202.

The static and kinetic braking torque of the foot 108 on the spool 152 is determined in part by the static and kinetic coefficients of friction between the foot 108 and the spool top surface 154, which in turn is determined in part by of what material the foot 108 is made. Thus, a user can predetermine the range of the braking torque of the tensioner, in part, by the type of material used in the foot 108. In some embodiments, the foot 108 is made of the same material as the rest of the tensioner 100, such as rubber or soft plastic. The braking torque of the foot 108 is also determined in part by the texture variation of the foot 108 portion, e.g., bumpy, corrugated, smooth, grainy, that contacts the spool top surface 154.

A guide 106 is proximate to the biasing member 104 and foot 108. The guide 106 substantially restricts the horizontal displacement of the foot 108. However, the guide 106 does allow the foot 108 a range of free movement vertically on the rod 150. In the displayed embodiment, the guide 106 is a second aperture 106 that is inserted onto the rod 150. In another embodiment, the guide 106 is contiguous with a slot (not shown) that extends to the edge of the foot 108. The second aperture 106 can be placed on the rod 150 by sliding the rod 150 through the slot.

In the displayed embodiment, the first aperture 102 has a greater depth than the second aperture 106. In other embodiments, the stop 110 and guide 106 include apertures of equal depth. The guide 106 is between at least a portion of the foot 108 and at least a portion of the biasing member 104. In the displayed embodiment, all diameters D of the second aperture 106 are greater than the diameter of the rod 150. Thus, the guide 106 does not grasp the rod 150. No or minimal static friction exists between the guide 106 and rod 150, which allows the foot 108 to move freely vertically on the rod 150. Thus, the force of the foot 108 against the spool top surface 154 is determined by force exerted from the biasing member 104 without interference from the guide 106. In some embodiments, there is some static friction between the guide 106 and rod 150, but this static friction is overcome in at least some positions by the force of biasing member 104.

Figure 6:
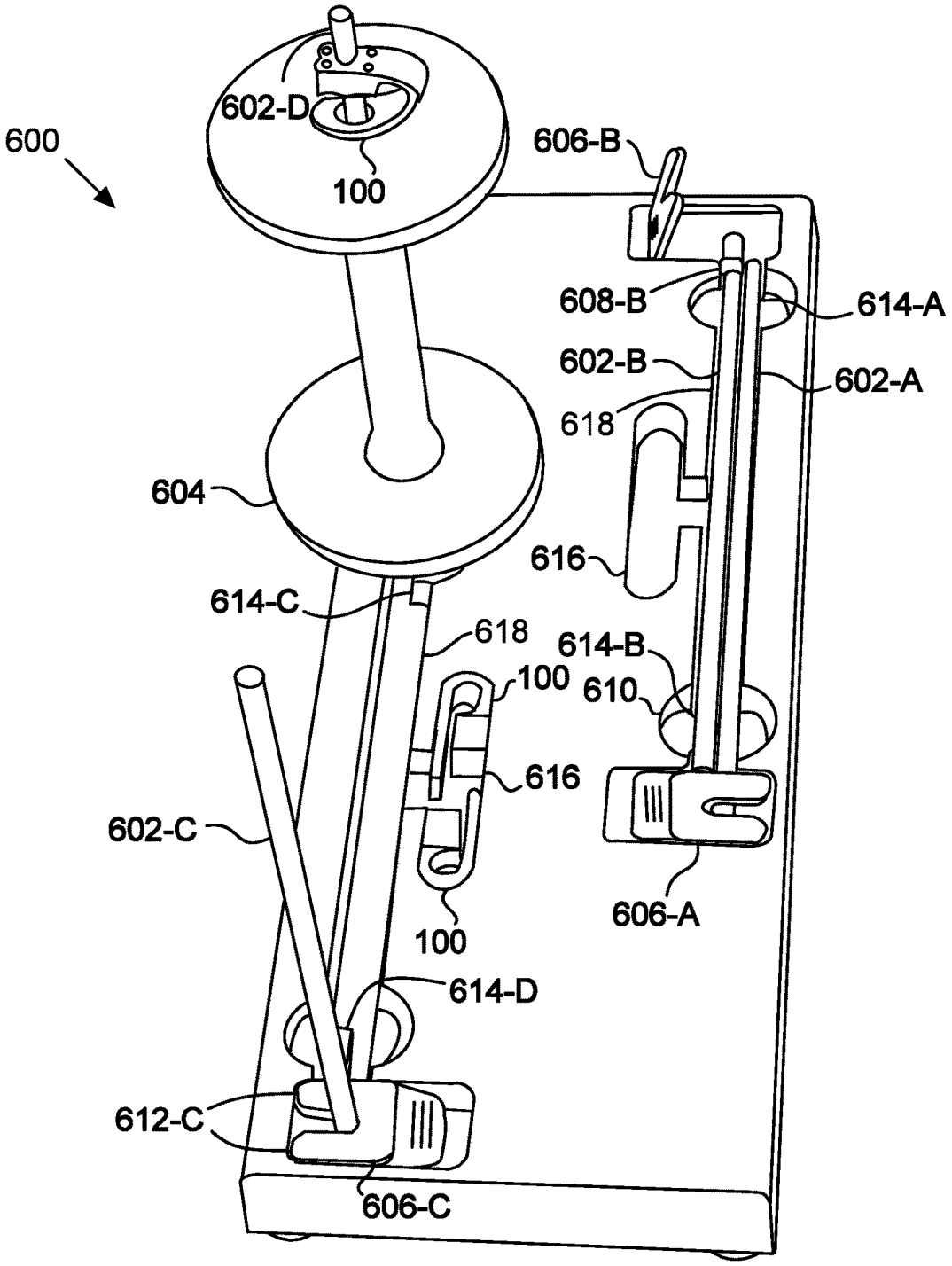
FIG. 6 is a top perspective view of one embodiment of a tensioner storage, line dispensing, and hand spinning system.

FIG. 6 illustrates a hand spinning system 600, which includes recesses 616 for storing tensioners 100. Each recess 616 is configured to receive two tensioners 100 in a bent position. When the tensioners 100 are stored in the recesses, the tensioners 100 are bent in a different position than when the tensioners 100 are placed on a rod 150, for example bent tensioner 100 shown in FIG. 1. Thus, spring fatigue during storage is mitigated even though they are in a bent position. In the displayed recess storage shown 616, the stop 110 and its corresponding foot 108 are parallel, but the first and second apertures 102, 106 do not align. In contrast, the first and second apertures 102, 106 do align when inserted onto a rod 150, as shown for example in FIG. 1. Note that the stored tensioner 100 closer to the bobbin 604 in FIG. 6 is retrieved by pinching the top and bottom of the foot 108, which is easily accessible.

The hand spinning system includes rods 602-A through -D upon which bobbins 604, spools, and tensioners 100 may be inserted. The rod 602-A is inside a channel 618, and the corresponding tab 606-A is down. The distal end of the rod 602-A rests on an outcropping 614-A and is higher than the proximal end. The rod 602-B is also inside the channel 618. The distal end of the rod 602-B rests on an outcropping 614-B and is higher than the end proximate the hinge 608-B. The corresponding tab 606-B is up, and rod 602-B is capable of being pivoted on its hinge 608-B to a vertical position by inserting a finger at access 610 and pulling the rod 602-B vertical. The rod 602-C is vertical. The corresponding tab 606-C is down and its projections 612-C stabilize rod 602-C and prevent it from pivoting. The rod 602-D is vertical and stabilized by its corresponding tab 602-D (not shown). A bobbin 604 is inserted on the rod 602-D. A tensioner 100 is inserted on the rod 602-D on top of the bobbin 604, acting as a holder and a braking torque for the bobbin 604.

Figure 7:
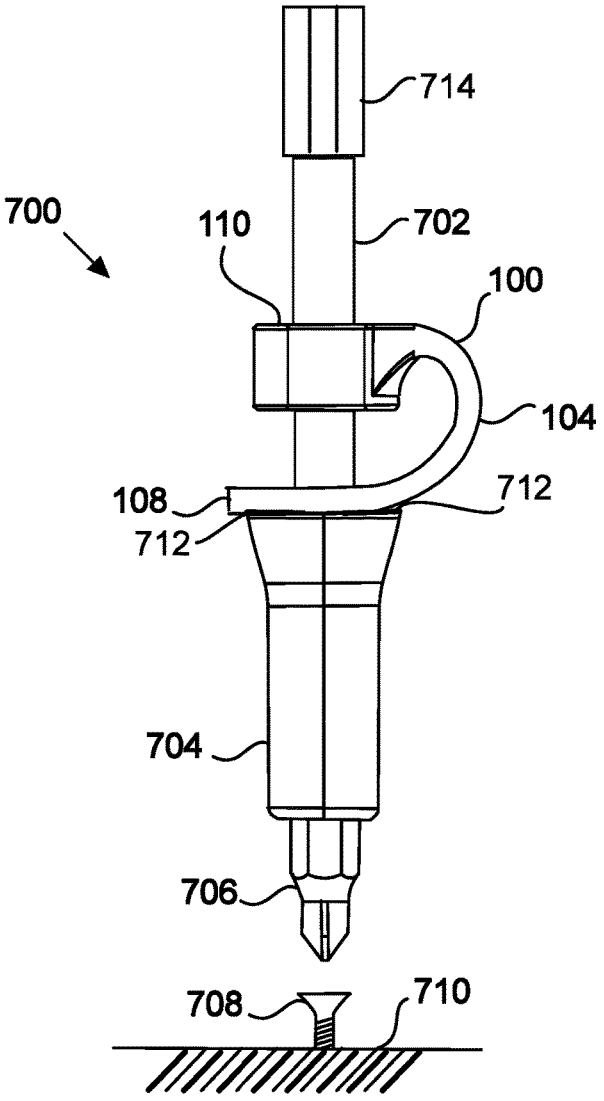
FIG. 7 is a side plan view of one embodiment of a tensioner slip clutch system.
Figure 8:
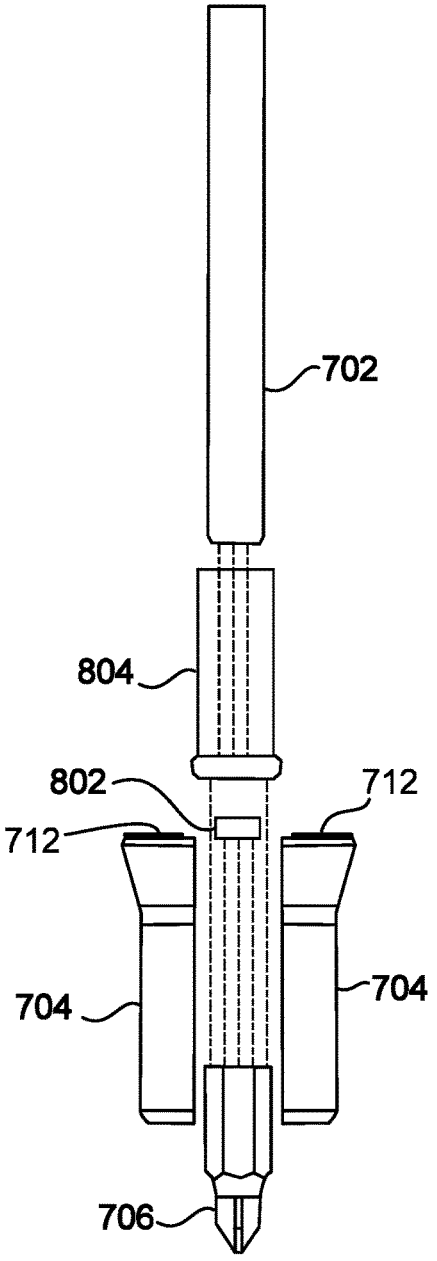
FIG. 8 is an exploded view of one embodiment of a tensioner slip clutch system.

FIGS. 7 and 8 illustrate a tensioner 100 as part of a slip clutch system 700. The slip clutch system 700 allows a user to set and adjust the torque of a bit 706 to a fixed predetermined setting. In one embodiment, the predetermined torque of the bit 706 is less than any torque-limiting setting on an ordinary electric drill and is appropriate for driving screws into soft material, such as wax, soft plastic, and foam. The use of the system 700 for a low predetermined torque is also appropriate for driving a screw or bolt into a thin plate with spacing underneath, for example, an electric switch plate.

The tensioner 100 is placed on a drive shaft 702. The drive shaft 702 is coupled to a rotating drive source, for example, a hand drill (not shown). In the displayed embodiment, the drive shaft 702 includes a hex portion 714 for inserting into a drill chuck (not shown). In other systems, the rotating drive source is hand-powered. Spin sleeve 704 and bit 706 rotate in a fixed position relative to one another. However, the drive shaft 702 rotates independently of the spin sleeve 704 and bit 706 when the tensioner 100 is not present. In the displayed embodiment, the rotational independence of the shaft 702 from the drive bit 706 is achieved by separating the drive bit 706 from the drive shaft 702 with a thrust plate 802. The rotational independence of the drive shaft 702 from the spin sleeve 704 is achieved by separating the drive shaft 702 from the spin sleeve 704 with a stop sleeve 804. In other embodiments, other means such as bearings or repelling magnets are used to decouple the bit/sleeve 706/704 rotation from the drive shaft 702 rotation.

In FIG. 7, the stop 110 of the tensioner 100 grips the drive shaft 702 with a first static torque (i.e., a force resisting being rotated relative to the shaft). The biasing member 104 is pressing the foot 108 of the tensioner 100 against the spin sleeve 704. The downward force of the foot 108 on the spin sleeve 704 creates a second static torque holding the foot 108 and spin sleeve 704 in a fixed relative position. In the displayed embodiment 700, ridges 712 extend from the top of the spin sleeve 704 to catch against the foot 108 for extra traction. The second static torque is adjustable by increasing or decreasing the distance between the stop 110 and foot 108, thereby changing the force of the biasing member 104 against the foot 108. The maximum possible first static torque between the stop 110 and drive shaft 702 is greater than the second static torque between the foot 108 and spin sleeve 704—that is, if the drive shaft 702 and spin sleeve 704 were rotated in opposite directions, the bond between the foot 108 and spin sleeve 704 would break before the bond breaks between the stop 110 and drive shaft 702.

FIG. 7 displays the bit 706 prepared for use to drive a screw 708 into a soft material. In the displayed use, the soft material is soft plastic 710. The bit 706 is placed into the screw 708. When the drive shaft 702 rotates, the stop 110 also rotates along with the remainder of the tensioner 100, including the foot 108. The second static torque holds the foot 108 in a fixed position with the spin sleeve 704; therefore, the spin sleeve 704 and bit 706 rotate in a fixed position relative to the drive shaft 702 and tensioner 100. Note that pressing the drive shaft 702 with a varying downward force against the screw 708 or other object does not affect the first or second static torque.

The bit 706 turns the screw 708 into the soft material 710. The kinetic friction between the screw 708 and soft material 708 creates a third torque, which is a resistance against the bit torque. When the screw 708 is driven far enough into the soft material 710, the third torque eventually increases, i.e., the screw increases its resistance to further turning. When the third torque is greater than the second static torque, the bond between the foot 108 and spin sleeve 704 is broken. The drive shaft 702 continues to turn but the bit 706 does not. Thus, the maximum driving torque of the bit 706 is predetermined by the second static torque holding the foot 108 and spin sleeve 704 together. The second static torque in turn depends upon the elastic modulus of the biasing member 104, the static friction coefficient of the foot 108 and spin sleeve 704, and the distance between the stop 110 and foot 108. Thus, the slip clutch system 700 avoids damaging the soft material 710, the screw 708, or the bit 706. In another use, the slip clutch system 700 is used on a screw turning into a thin panel with a space, such as an electric switch plate.

Figure 9:
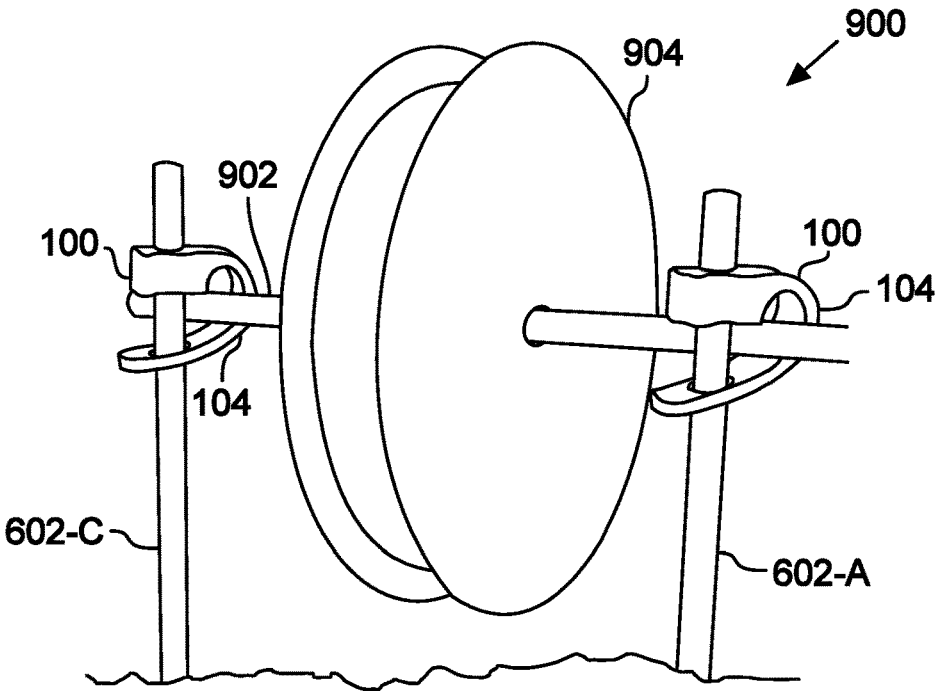
FIG. 9 is a front perspective view of a horizontal spindle support system.

FIG. 9 illustrates two tensioners 100 as part of a system 900 for supporting for a shaft 902 that acts as a spindle. One tensioner 100 each is placed on two vertical rods 602-A, 602-C of the hand spinning system 600. The shaft 902 is inserted between each biasing member 104 and rod 602-C, 602-A. In the displayed use, the shaft 902 is horizontal. In other embodiments, the shaft 902 is supported at an angle, which depends upon the height difference between the tensioners 100.

The tensioners 100 are turned such that the biasing members 104 press the shaft 902 against the rods 602-C, 602-A, thereby holding the shaft 902 in place with static friction. The rods 602-C, 602-A and biasing members 104 also create a braking torque on the shaft 902 turning, thereby acting as a tensioner for the spool 904 which is rotationally fixed relative to the shaft 902. The braking force of the biasing member 104 against the spindle is predetermined by how hard the user turns the tensioner 100 against the spindle.

In some embodiments, the spool 904 and shaft 902 are not rotationally fixed relative to one another. Additional tensioners 100 are added to the shaft 902 such that their feet 108 press against each side of the spool 904. In one embodiment, the static torque of the tensioners 100 on the vertical rods 602-C, 602-A is greater than the braking torque of the tensioners 100 pressing against the spool 904. In this embodiment, the tensioners 100 pressing against the spool 904 remain in a fixed position and exert a braking torque on the spool 904 as it rotates. In another embodiment, the static friction of the tensioners 100 pressing against the spool 902 is greater than the braking torque of the tensioners 100 on the vertical rods 602-C, 602-A. In this embodiment, the shaft 902, tensioners pressing against the spool 904, and spool 904 rotate in a fixed position relative to one another, and the tensioners 100 on the vertical rods 602-C, 602-A exert a braking torque on the shaft 902.

Figure 10:
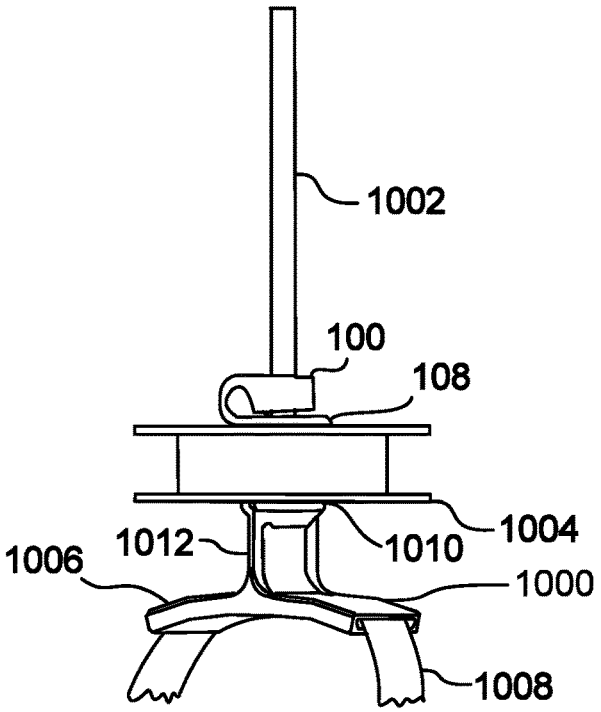
FIG. 10 is a side isometric view of a portable spool dispenser.

FIG. 10 illustrates a tensioner 100 incorporated into a portable dispenser 1000 configured to temporarily affix to an anchor, for example, to the user's leg. The dispenser 1000 includes a rod 1002 affixed to a base 1012. The base 1012 is affixed to a holder 1006 configured to allow a strap 1008 to be run through the dispenser 1000. In the displayed embodiment, the bottom surface of the holder 1006 is curved in order to rest comfortably on a user's leg. In other embodiments, the holder 1006 is configured to rest against a chair, table, pole, or other anchor. In other embodiments, the holder 1006 is a suction cup, c-clamps, or other securing mechanisms.

A user places a spool 1004 on the rod 1002 and secures the spool 1004 in place between the top surface 1010 of the base 1012 and a tensioner 100. The user is then able to move the apparatus 1000 and spool 1004 without needing to worry about the spool 1004 falling off the rod 1002. The tensioner foot 108 exerts a braking torque on the spool 1004. The user anchors the apparatus 1000 to the user's leg with the strap 1008. Note that the spool 1004 will be held in place and tensioned by the tensioner 100 regardless of whether the user is standing or sitting.

Figure 11:
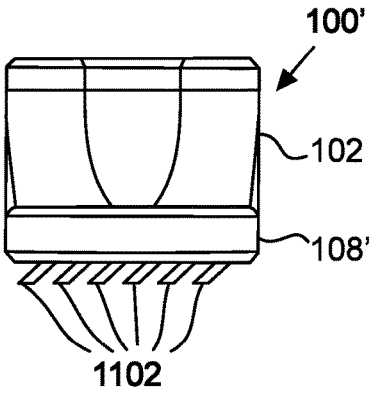
FIG. 11 is a front plan view of another embodiment of a tensioner.
Figure 12:
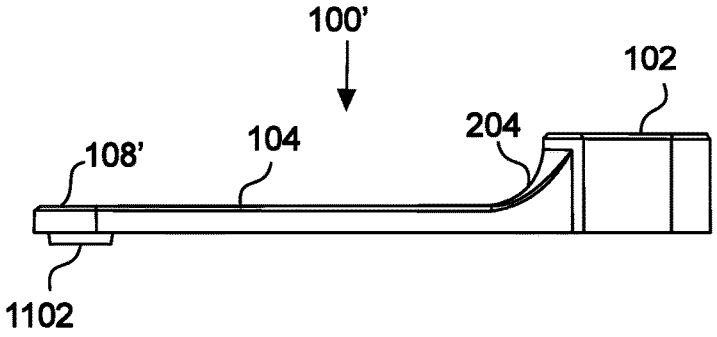
FIG. 12 is a side plan view of the tensioner embodiment of FIG. 11.

FIGS. 11 and 12 illustrate an embodiment of the tensioner 100' with extensions 1102 extending from the foot 108'. The extensions 1102 press against the spool top surface 154. The extensions' 1102 braking torque on a spool 152 vary depending upon the direction in which the spool 152 is rotating. In the displayed embodiment, the extensions 1102 are made of a flexible material, such as rubber or soft plastic. In the FIG. 11 embodiment, the extensions 1102 slant down leftward from the bottom of the foot 108. In other embodiments, the extensions 1102 slant down rightward from the bottom of the foot 108. When the spool 152 rotates left, the extensions 1102 bend left as well and exert a first braking torque on the spool 152. When the spool 152 rotates right, the extensions 1102 fold and bind and exert a second braking torque on the spool 152 which is greater than the first braking torque 152. Thus, the tensioner 100' performs as a tensioner when the spool 152 rotates left, and performs as a brake when the spool 152 rotates right. Therefore, the tensioner 100' allows the spool 152 to rotate effectively in only one direction.

In other embodiments, the extensions 1102 are made of other structures capable of limiting a spool's 152 rotation to only one direction. For example, in one embodiment, the extensions 1102 are ratchet teeth with corresponding receptors embedded in the top surface 154 of the spool 152. In another embodiment, the extensions 1102 are spring-loaded sharp teeth that slant in one direction and dig into the top surface 154 of the spool 152 when the spool is turning against the teeth.

Figure 13:
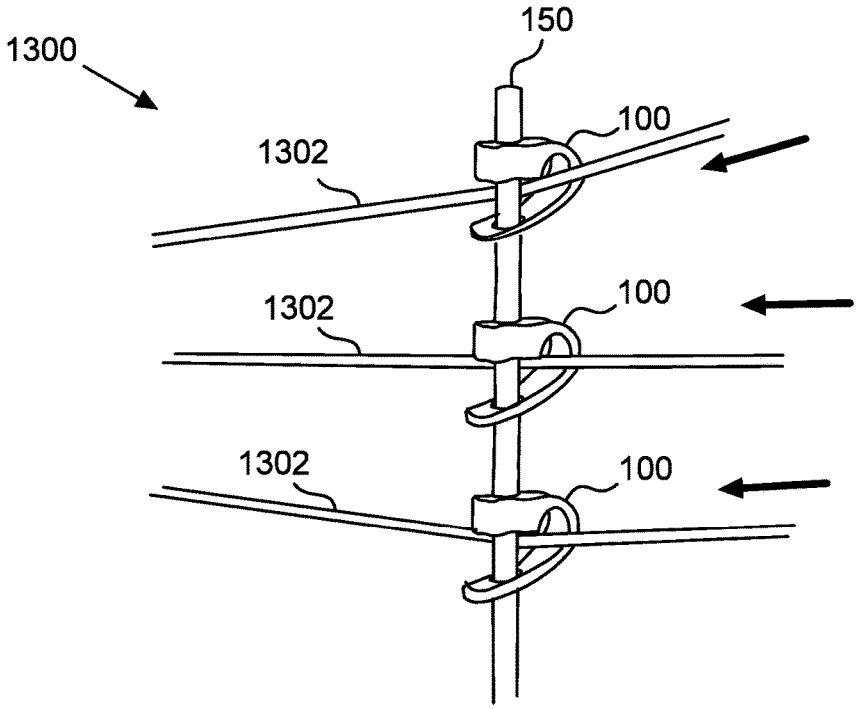
FIG. 13 is a side perspective view of a system for combining multiple strands.

FIG. 13 illustrates a system for guiding multiple strands 1302, for example, as a yarn guide. Three tensioners 100 are placed on a single rod 150. Individual strands 1302 that originate from different spools (not shown) extend between the bent biasing member 104 and rod 150 of individual tensioners 100. The multiple strands 1302 are thus redirected. The aligned strands 1302 can then be handled by a single user to combine the strands 1302 together. The individual tensioners 100 are adjusted up or down on the rod 150 as needed to align the strands 1302 as appropriate. In other system embodiments, more or less than three tensioners 100 are used. In other system embodiments, multiple rods 150 with tensioners 100 are used.

Figure 14:
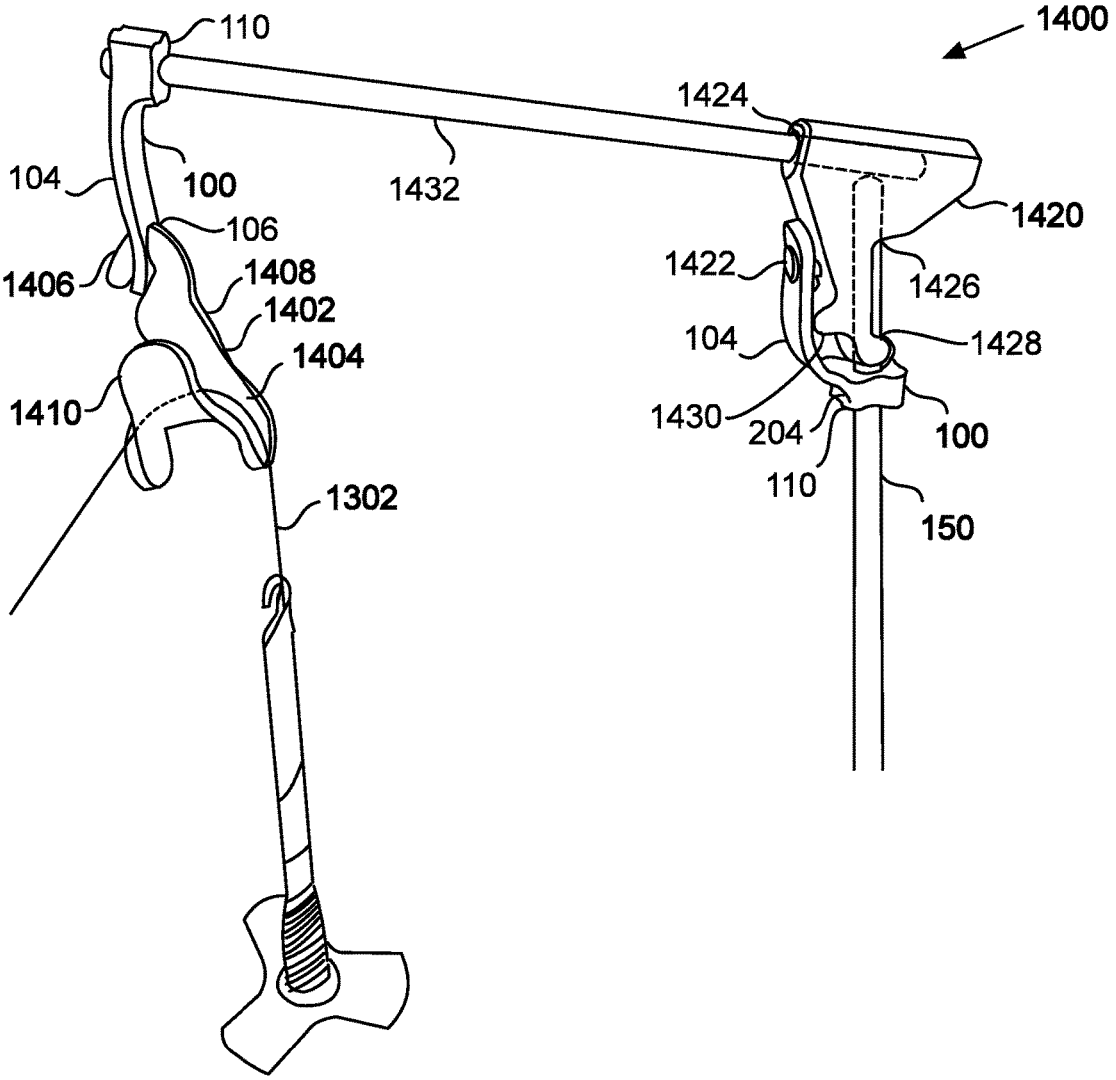
FIG. 14 is a side perspective view of a tensioner crane system.

FIG. 14 illustrates a crane system 1400. The crane system 1400 is shown suspending and guiding a strand 1302. In other embodiments, the crane system 1400 is used to support other suspended objects, for example, a drying painted object.

The crane 1420 is supported by a rod 150. The rod 150 is inserted through two apertures 1428, 1426. The boom 1432 is inserted into a receiver 1424. The receiver 1424 for the boom 1432 and the apertures 1428, 1426 for the rod 150 are aligned relative to each other such that the angle between the rod 150 and boom 1432 is greater than 90 degrees. When the rod 150 is vertical, the boom 1432 extends upward away from the crane 1420.

The stop 110 of a tensioner 100 is inserted onto the rod 150 such that the tensioner transition 204 faces downward away from the crane 1420. A knob 1422 extends from the crane 1420 in substantially the same direction as the receiver 1424. The guide 106 fits over the knob 1422.

The tensioner 100 restricts the crane 1420 from rotating about the axis of the rod 150 and from pivoting the boom 1432 up and down. The flat shape of the biasing member 104 prevents it from bending along the plane of the biasing member's 104 top and bottom surfaces. The stop's 110 frictional static force against the rod 150 prevents the stop 110 from rotating. Thus, the crane 1420 is prevented from rotating about the axis of the vertical rod 150.

The crane 1420 includes a protrusion 1430. The protrusion 1430 presses the biasing member 104 into a bent position, thereby increasing the biasing member's upward force against the knob 1422. Thus, the crane 1420 is prevented from pivoting forward and backward, and the boom 1432 is prevented from being unintentionally raised and lowered during use.

The stop 110 of a second tensioner 100 is attached to the distal end of the boom 1432. The tensioner 100 suspends a router 1402 from the boom 1432.

In one embodiment, the router 1402 is manufactured as a single piece from a mold. In another embodiment, the router 1402 is made of a single folded sheet of material. In one embodiment the router 1402 material is hard, transparent, and lightweight, for example, clear plastic. The router 1402 includes a hook 1406 located at the top of the rear wall 1408. The hook 1406 is flat and wider than the diameter D of the guide 106. The hook 1406 fits snugly in the flexible guide 106. The rear wall 1408 and a front wall 1410 are vertical and substantially parallel with one another. The rear wall 1408 and front wall 1410 are connected at their bottoms by an open channel 1404. The channel 1404 is a U-shaped arc that curves downward at each end. The top surface of the channel 1404 is hard and smooth, thereby allowing the strand 1302 to glide over the channel 1404 without catching.

FIGS. 15 and 16 illustrate a tensioner 100 incorporated into a portable dispenser 1500. The dispenser 1500 is affixable to flat surfaces, for example, tabletops and windows. The tensioner 100 is inserted onto a rod 150. The rod 150 is inserted into a receiver 1516 that is part of a cam 1506. The dispenser 1500 is collapsible such that it can be either in a first collapsed position (FIG. 15) or a second extended position (FIG. 16).

The cam 1506 is coupled with a pivot rod 1802 to a stud 1702 that extends from a suction cup 1502. As shown in FIG. 18, the pivot rod 1802 is inserted into a receiver 1510. The receivers 1516, 1510 are configured such that the rod 150 and pivot rod 1802 are perpendicular to one another when fully inserted. The cam 1506 includes a top surface 1508 that is flat. A spool 1004 is inserted onto the rod 150 between the top surface 1508 and the tensioner 100.

FIG. 17 illustrates an exploded view of the cap 1504 and suction cup 1502 portion of the portable dispenser 1500. The stud 1702 is inserted through a receiver 1704. The cap 1504 is interposed between the cam 1506 and the suction cup 1502. In one embodiment, the cap 1504 and cam 1506 are made of materials with a higher Young's modulus than the material the suction cup 1502 is made of. In one embodiment, the cap 1504 is made of hard plastic and the suction cup 1502 is made of silicon. In another embodiment, the suction cup 1502 is made of rubber.

The cam 1506 includes two feet 1512. The width of the stud 1702 is substantially equal to the distance between the two feet 1512. As shown in FIG. 15, the feet 1512 do not press against the cap 1504 when the dispenser 1500 is in a stored and folded position.

When the cam 1506 is rotated to an upright position, the feet corners 1518 press against the cap 1504, while the suction cup 1502 is simultaneously pulled upward from the center stud 1702. As a result, the suction cup outer portion 1706 is pressed flat by the cap outer portion 1708, thereby affixing the bottom of the suction cup 1502 to a surface.

FIG. 16 displays the portable dispenser 1500 in a fully extended position. The bottom of the feet 1512 are flush against the cap 1504 in a clamped and stable position. The bottom of the feet 1512 in the fully extended position exert less pressure than the corners 1518 did against the cap 1504 during rotation. The feet 1512 include stoppers 1514 that are configured to be flush against the cap 1504 when the cam 1506 is in an upright position.

From the foregoing description, it will be recognized by those skilled in the art that a quick-adjust tensioner has been provided. While the present invention has been illustrated by description of several embodiments and methods of use, and while the illustrative embodiments and methods of use have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A tensioner, comprising:

a stop, a first member, and a foot;

said stop includes a first aperture, wherein at least a portion of said stop that defines said first aperture comprises a resilient material;

said first member connects said stop to said foot, said first member is resilient, said first member is configured to bias to a straight position;

said foot includes a second aperture, said second aperture is circular, wherein any diameter of said second aperture is greater than the smallest diameter of said first aperture, said first and second apertures are parallel when said first member is in said straight position;

wherein a first side of said stop, a first side of said first member, and a first side of said foot are contiguous and defined by a first plane when said first member is straight;

wherein a second side of said stop, a second side of said first member, and a second side of said foot are contiguous, said second side of said first member is defined by a second plane when said first member is straight;

wherein a third side of said stop, a third side of said first member, and a third side of said foot are contiguous, said third side of said first member is defined by a third plane when said first member is straight;

wherein said stop is thicker than said foot such that a height of said first aperture is greater than a height of said second aperture;

wherein said first member is capable of bending such that said first aperture aligns completely superposed in said second aperture;

wherein said first member is capable of bending such that said stop contacts said foot such that said first and second apertures are coaxial while said first member maintains full resilience to bias return to said straight position.

2. The tensioner of claim 1, said tensioner consists of a single homogenous material.

3. The tensioner of claim 1, said tensioner is a single integral piece.

4. The tensioner of claim 1, said first member is flat and smooth.

5. The tensioner of claim 1, said stop and said foot are on opposite distal ends of said tensioner.

6. The tensioner of claim 1, said stop includes at least one third aperture, said third aperture is parallel to said first aperture, wherein all material directly between said first aperture and said third aperture is resilient.

7. The tensioner of claim 6, said stop includes a plurality of third apertures.

8. The tensioner of claim 1, said tensioner is a material selected from a group consisting of plastic, rubber, and thermoplastic elastomer.

9. The tensioner of claim 1, wherein a surface of said first member and a surface of said foot are both substantially smooth.

10. A tensioner, comprising:

a first end, a middle, and a second end, said middle connects said first end to said second end, said middle is resilient, said middle is configured to bias to a straight position after said tensioner is bent such that said first end touches said second end;

said first end includes a first opening, said second end includes a second opening, said second opening is circular, said first and second openings define parallel surfaces when said middle is in said straight position;

said first opening has a non-uniform diameter, said first non-uniform diameter has at least two reflective symmetries and two rotational symmetries;

wherein any thickness of said middle is not less than any height of said second opening;

said tensioner is configured to fit on a rod, said rod is cylindrical, said rod has a uniform diameter and smoothness;

said first opening is configured to fit on said rod and exert a first static friction against said rod;

said second opening is configured to fit on said rod and exert a second static friction against said rod;

said middle is flexible such that said first and second openings are capable of fitting on said rod simultaneously; and said first static friction is greater than said second static friction.

11. The tensioner of claim 10, said first end is thicker than said middle, said first end includes a transition to said middle, said transition is radiused.

12. The tensioner of claim 10, said second end exerts a force away from said first end when said middle is bent.

13. An elongated strip, comprising:

a first through-opening proximate a first end and a second through-opening proximate a second end;

said first end is thicker than said second end;

said first through-opening is narrower than said second through-opening;

said second through-opening is cylindrical and has a uniform diameter;

said strip is flexible and resilient, said strip biases to a first position;

said first end and said second end are parallel in said first position;

a side portion extending from said first through-opening to said second through-opening, said side portion is contiguous with said first through-opening and said second through-opening, said side portion is flat in said first position;

the center axes of said first through-opening and said second through-opening are parallel in said first position; and at least a portion of material defining said first through-opening is flexible and resilient.

14. The elongated strip of claim 13, said first through-opening and said second through-opening are configured to fit in a second position on a straight rod of uniform width, wherein said first through-opening's static friction against said rod is greater than said second through-opening's static friction against said rod.

15. The elongated strip of claim 13, further comprising a third through-opening, said third through-opening is proximate said first end, the center axes of said first through opening and said third through-opening are parallel, said third through-opening is narrower than said first through-opening.

16. The elongated strip of claim 15, wherein all material directly between said first through-opening and said third through-opening is resilient.

17. The elongated strip of claim 13, said second end includes a top surface and a bottom surface, said top surface is flat, and said bottom surface is flat.

* * * * *